United States Patent [19]

Daugirda

[11] Patent Number: 4,488,342

[45] Date of Patent: Dec. 18, 1984

[54] VESSEL CONSTRUCTION EMPLOYING MULTIPLE INTERNAL HEAT EXCHANGE TUBES

[75] Inventor: Paul G. Daugirda, Evergreen Park, Ill.

[73] Assignee: Rheem Manufacturing Company, New York, N.Y.

[21] Appl. No.: 389,591

[22] Filed: Jun. 18, 1982

Related U.S. Application Data

[60] Division of Ser. No. 116,272, Jan. 28, 1980, abandoned, and a continuation of Ser. No. 280,447, Jul. 6, 1981, Pat. No. 4,415,020.

[51] Int. Cl.[3] ..... B23P 15/26; F28F 9/16

[52] U.S. Cl. ..... 29/157.3 R; 29/157.4; 29/157.3 C; 165/76; 165/133; 228/183

[58] Field of Search ..... 29/157.3 R, 157.3 C, 29/157.4, 463, 526.2, 526.4, 426.2; 228/183, 173 A; 113/1 C, 118 R, 118 C, 118 V; 165/133, 149, 148, 173, 175, 151, 157, 158

[56] References Cited

U.S. PATENT DOCUMENTS

| | | | |
|---|---|---|---|
| 191,868 | 6/1877 | Lowe . | |
| 724,210 | 3/1903 | Scherer | 29/157.3 R |
| 970,561 | 9/1910 | Scaramuzza . | |
| 1,320,652 | 11/1919 | Sonneborn | 113/118 R |
| 1,728,377 | 9/1929 | Trane | 113/118 R |
| 1,893,330 | 1/1933 | Jones | 113/118 R |
| 1,959,464 | 5/1934 | Dryden | 113/118 R |
| 2,298,996 | 10/1942 | Woods | 113/118 R |
| 2,389,175 | 11/1945 | Woods | 113/118 R |
| 3,268,989 | 8/1966 | Erwin et al. . | |
| 4,170,055 | 10/1979 | Zethraeus | 113/118 V |

FOREIGN PATENT DOCUMENTS

| | | |
|---|---|---|
| 571330 | 1/1924 | France . |
| 5662 | of 1908 | United Kingdom . |
| 505127 | 11/1938 | United Kingdom . |
| 567726 | 2/1945 | United Kingdom . |
| 666131 | 2/1952 | United Kingdom . |
| 953021 | 3/1964 | United Kingdom . |
| 1000238 | 8/1965 | United Kingdom . |
| 1192381 | 3/1966 | United Kingdom . |
| 1105311 | 3/1968 | United Kingdom . |
| 1538420 | 1/1979 | United Kingdom . |

*Primary Examiner*—Howard N. Goldberg
*Assistant Examiner*—V. K. Rising
*Attorney, Agent, or Firm*—Allegretti, Newitt, Witcoff & McAndrews, Ltd.

[57] ABSTRACT

A hot water heater tank is formed from a cylindrical body or tube and a header subassembly. The header subassembly includes first and second headers sized to fit in separately sized sections of the body of the tank. The subassembly, comprising the headers and interconnecting heat exchange tubes, is coated with a protective ceramic material prior to insertion into the cylindrical body of the tank.

2 Claims, 3 Drawing Figures

VESSEL CONSTRUCTION EMPLOYING MULTIPLE INTERNAL HEAT EXCHANGE TUBES

CROSS REFERENCE TO A RELATED APPLICATION

This is a division of Ser. No. 116,272 filed Jan. 28, 1980, now abandoned, and U.S. Pat. No. 4,415,020 issued Nov. 15, 1983.

BACKGROUND OF THE INVENTION

This invention relates to an improved method of manufacture of vessels which employ multiple internal heat exchange tubes.

Historically the manufacture of vessels which employ multiple internal heat exchange tubes has presented problems of warpage due to buildup of stresses as a result of temperature differences encountered during the welding or brazing process utilized to attach the tubes to headers forming the vessel. Such warpage is a significant problem in vessels which have precoated parts particularly where the precoating material is a ceramic or porcelain material of a type which insures corrosion protection.

That is, a common practice in the manufacture of vessels is to take a tubular body and weld headers or end plates to the end of the body thereby forming an enclosed tank. The interior of the tank is then coated with a ceramic or porcelain material for corrosion protection. Subsequently, heat exchange tubes are inserted through openings in the end plates of the tank or headers. These heat exchange tubes are then welded to the headers. The welding process often causes warpage of the headers and the tube ends resulting in cracking of the protective coating. This, in turn, exposes the metal surface to corrosive activity, particularly in a water heater tank assembly.

The present invvention constitutes a method of manufacture as well as an assembly which seeks to overcome the problem of degradation of the protective coating material on the inside of a tank or vessel of the type which has multiple internal heat exchange tubes.

SUMMARY OF THE INVENTION

The method of the present invention includes the initial step of manufacture of a subassembly comprising heat exchange tubes connected between headers. This subassembly may then be coated with a corrosion resistant material. The subassembly is next inserted into a tube or vessel body for formation of the final tank or vessel. One of the headers is sized smaller than the other header. The tube or body is shaped and sized to be compatible with the respective headers.

Thus, it is an object of the present invention to provide an improved method of manufacture of a vessel or tank which employs multiple internal heat exchange tubes.

A further object of the present invention is to provide an improved method of manufacture of a vessel wherein the likelihood of degradation of a protective coating on the interior of the vessel is diminished.

Still another object of the present invention is to provide an improved method of manufacture and construction for a vessel which is economic and will result in an improved number of acceptable vessels being constructed during a manufacturing process.

These and other objects, advantages and features of the present invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

The vessel of the present invention includes a subassembly comprised of first and second headers at 10 and 12 which are interconnected by a plurality of heat exchange tubes 14. The subassembly is then inserted into a vessel body or tank 16 and welded or brazed into position.

Figure 1:
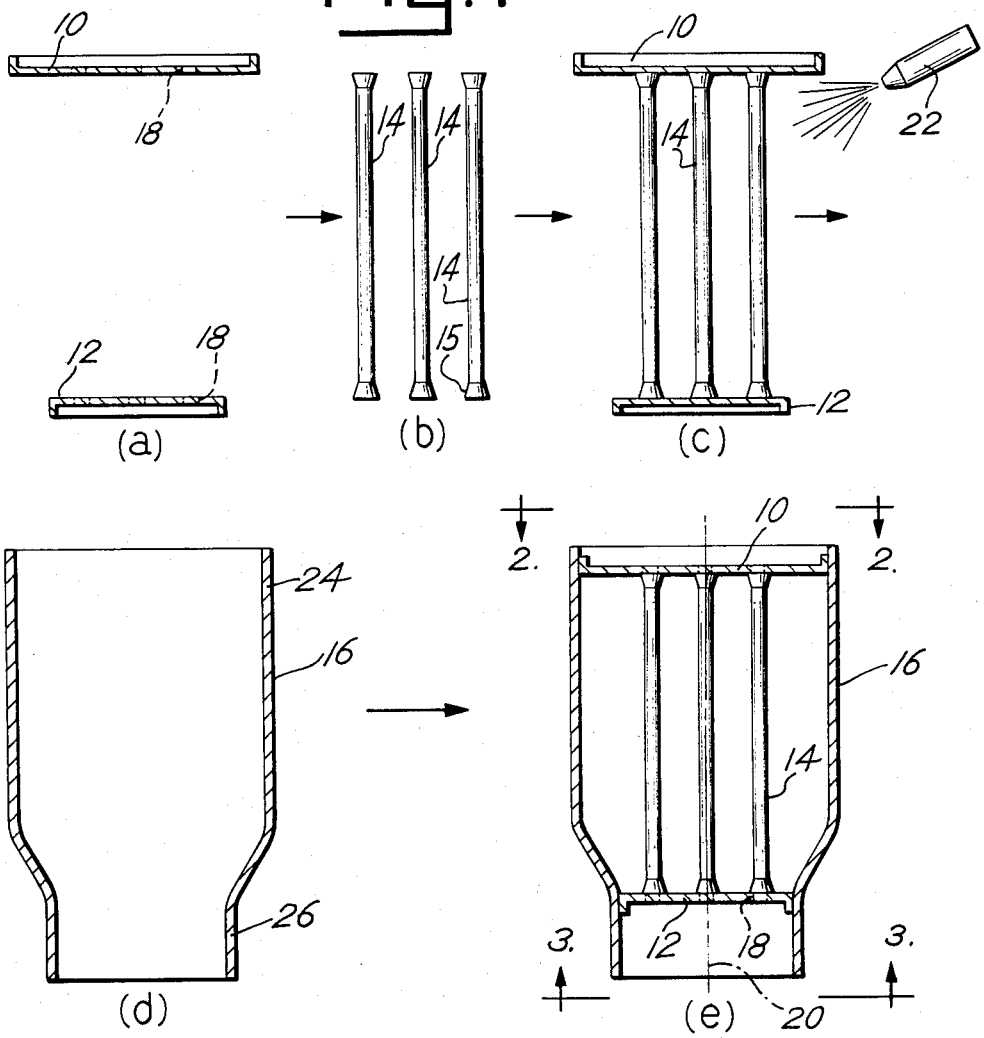
FIG. 1, parts (a) through (e) comprise a side elevation illustrating the steps comprising the method of the invention and the component parts of a vessel.

As shown in FIG. 1, parts (*a*)-(*c*), the sequence of operations or steps in the manufacture of the completed vessel includes forming the headers 10, 12 so that they have substantially the same shape. However, one of the headers 12 is formed smaller than the other header 10. The headers 10 and 12 include a plurality of openings 18 for receipt of the tubes 14. Openings 18 in the headers 10, 12 are adapted to receive the flared ends 15 of tubes 14 and the ends 15 of the tubes 14 are then flared. The tubes 14 are then welded or brazed or otherwise metallurgically affixed to the headers 10, 12. Preferably the tubes 14 are arranged in parallel array so that they will ultimately be parallel to a vertical axis 20 of the assembled vessel.

The subassembly comprising the headers 10, 12 and the tubes 14 may then be coated as shown in FIG. 1 part (c) by a protective coating material such as a ceramic or porcelain material. A coating applicator 22 is schematically illustrated in FIG. 1 part (c) for applying the coating on the subassembly and particularly on the portion of the subassembly which will be on the inside of the final vessel construction.

Figure 2:
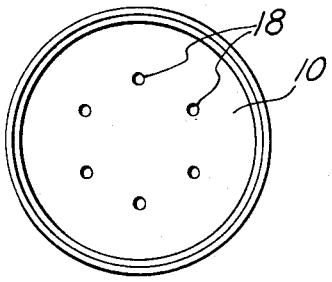
FIG. 2 is a top plan view of the assembled vessel taken along the line 2—2 in FIG. 1.
Figure 3:
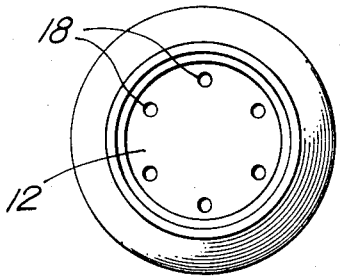
FIG. 3 is a bottom plan view of the assembly vessel taken along the line 3—3 in FIG. 1.

The next steps are illustrated in FIG. 1 parts (c) and (d). The tank body 16 has a cross sectional shape adapted to receive the headers 10, 12. The tank body 16 is divided into an upper section 24 which will receive the header 10 and a lower section which will receive the header 12. The dimensional difference between the sections 24 and 26 is small. However, the dimension difference insures that the header assembly will be properly inserted and retained in the tank body 16. The interior of the tank body 16 may be precoated with a protective material such as a ceramic or porcelain material. Then, upon insertion of the subassembly as shown in part (e) of FIG. 1, the headers 10 and 12 may be welded or brazed or otherwise metallurgically affixed to the tank body 16. FIGS. 2 and 3 are end views of the final assembled vessel.

Typically, the finished vessel as depicted in FIG. 1, part (e) comprises part of a hot water heater assembly. Water is heated in the vessel by a gas burner positioned beneath the header 12. Hot gases flow through heat exchange tubes 14.

The shape or size of the body 16 in the final vessel assembly may be varied. That is, the headers may be rectangular as may be the tank body. One header may be rectangular and the other header may have another shape. Various other combinations are possible. Importantly, a subassembly comprising the headers 10, 12 and tubes 14 is fabricated and coated thereby allowing inspection of the coated surface prior to final assembly with the body 16. With the method of the present invention, the deterioration of the interior vessel coating material is prevented. Thus, the scope of the invention is to be limited only by the following claims and their equivalents.

What is claimed is:

1. A method of manufacture of a water heater tank of the type including a tank body, heat exchange tubes positioned in the body and headers attached to the opposite ends of the tubes to enclose a volume within the body, comprising the steps of:

(a) forming first and second opposed headers of identical shape and a separate, uniform constant transverse dimension, the first one of the headers defining a uniform constant transverse dimension smaller than the transverse dimension of the second header;

(b) metallurgically affixing a plurality of tubes through the opposed headers to provide a header and tube subassembly;

(c) forming a tubular body having a uniform cross sectional interior shape along the length of the body identical to the shape of the headers and further forming the body with two transverse dimension regions, for slidable and adjustable receipt of the headers, with one region of the body being formed with a uniform, constant transverse dimension to slidably receive the first, smaller header only and the other region of the body being formed with a uniform, constant transverse dimension to slidably receive the second header;

coating the portion of the header and tube subassembly that forms the interior of water heater tank with a protective material;

(e) initially inserting the first header and tube subassembly into the larger end of the tubular body and then slidably positioning said subassembly with the first, smaller header received and circumferentially retained by the smaller dimension portion of the body and the other, second header received and circumferentially retained by the other relatively larger dimensioned portion of the body; and (f) metallurgically affixing the headers to the body to form an enclosed tank.

2. The method of claim 1 including the step of applying a protective ceramic coating material by spraying onto the surface of the tubes and header which will be on the inside of the tank, said application of said ceramic coating material taking place prior to insertion of the subassembly into the body and subsequent to metallurgically affixing the tubes to the headers.

* * * * *